US011631375B2

(12) United States Patent
Liu et al.

(10) Patent No.: US 11,631,375 B2
(45) Date of Patent: Apr. 18, 2023

(54) DISPLAY EQUIPMENT AND OPERATION METHOD THEREOF AND BACKLIGHT CONTROL DEVICE THAT SOLVES FLICKER PHENOMENON OF VARIABLE REFRESH RATE VIDEO FRAME

(71) Applicant: Wistron Corporation, New Taipei (TW)

(72) Inventors: Yuanliang Liu, New Taipei (TW); Mingyue Geng, New Taipei (TW); Yueqi Xu, New Taipei (TW); Junxin Qiu, New Taipei (TW); Chih-Chou Chou, New Taipei (TW)

(73) Assignee: Wistron Corporation, New Taipei (TW)

( * ) Notice: Subject to any disclaimer, the term of this patent is extended or adjusted under 35 U.S.C. 154(b) by 17 days.

(21) Appl. No.: 17/393,375

(22) Filed: Aug. 3, 2021

(65) Prior Publication Data

US 2022/0415269 A1 Dec. 29, 2022

(30) Foreign Application Priority Data

Jun. 25, 2021 (CN) ..... 202110710184.0

(51) Int. Cl.
*G09G 3/34* (2006.01)
*G09G 5/10* (2006.01)

(52) U.S. Cl.
CPC ..... *G09G 3/3406* (2013.01); *G09G 5/10* (2013.01); *G09G 2310/08* (2013.01);
(Continued)

(58) Field of Classification Search
CPC .... G09G 3/3406; G09G 5/10; G09G 2310/08; G09G 2320/0646; G09G 2320/0686; G09G 2340/0435; G09G 2360/16
See application file for complete search history.

(56) References Cited

U.S. PATENT DOCUMENTS 8,451,211 B2 5/2013 Yu
8,963,826 B2 2/2015 Oda et al.
(Continued)

FOREIGN PATENT DOCUMENTS

CN 101471043 7/2009
CN 201584141 9/2010
(Continued)

OTHER PUBLICATIONS

"Office Action of Related U.S. Appl. No. 17/160,413", dated Nov. 16, 2021, pp. 1-14.
(Continued)

*Primary Examiner* — Stephen G Sherman
(74) *Attorney, Agent, or Firm* — JCIPRNET

(57) ABSTRACT

The invention provides a display equipment, an operation method thereof, and a backlight control device. The display equipment includes a display panel, a backlight module, an image processing circuit, a panel control circuit, a first backlight control circuit, and a second backlight control circuit. The image processing circuit provides a VRR video frame to the panel control circuit. The first backlight control circuit generates a main dimming signal to the backlight module during a valid data period of the VRR video frame according to a first timing information of the image processing circuit. The second backlight control circuit generates a compensation dimming signal to the backlight module during a blank period of the VRR video frame according to a second timing information of the image processing circuit. In particular, a peak current value of the compensation dimming signal is less than a peak current value of the main dimming signal.

21 Claims, 8 Drawing Sheets

(52) U.S. Cl.
CPC ..... *G09G 2320/0646* (2013.01); *G09G 2320/0686* (2013.01); *G09G 2340/0435* (2013.01); *G09G 2360/16* (2013.01)

(56) References Cited

U.S. PATENT DOCUMENTS

| | | | | |
|---|---|---|---|---|
| 9,299,297 | B2 | 3/2016 | Shibamiya et al. | |
| 10,210,822 | B2 | 2/2019 | Zhang et al. | |
| 10,490,137 | B2 | 11/2019 | Fu et al. | |
| 10,692,443 | B2 | 6/2020 | Wu et al. | |
| 2005/0083353 | A1 | 4/2005 | Maruyama et al. | |
| 2009/0243993 | A1 | 10/2009 | Kuga | |
| 2011/0157111 | A1 | 6/2011 | Lee et al. | |
| 2011/0169852 | A1 | 7/2011 | Yu | |
| 2014/0160180 | A1 | 6/2014 | Oda et al. | |
| 2014/0198123 | A1 | 7/2014 | Shibamiya et al. | |
| 2016/0335957 | A1 | 11/2016 | Fu et al. | |
| 2018/0075813 | A1 | 3/2018 | Zhang et al. | |
| 2019/0164506 | A1 | 5/2019 | Wu et al. | |
| 2019/0251914 | A1* | 8/2019 | Chen | G09G 3/342 |
| 2020/0066215 | A1* | 2/2020 | Koo | G09G 3/3607 |
| 2020/0135074 | A1 | 4/2020 | Wooster et al. | |
| 2020/0135146 | A1* | 4/2020 | Lee | G09G 5/006 |
| 2021/0193065 | A1* | 6/2021 | Smith | G09G 3/3614 |

FOREIGN PATENT DOCUMENTS

| | | |
|---|---|---|
| CN | 103718235 | 4/2015 |
| CN | 104505055 | 2/2017 |
| CN | 106297674 | 7/2019 |
| CN | 109859696 | 10/2020 |
| TW | M373544 | 2/2010 |
| TW | 201125363 | 7/2011 |

OTHER PUBLICATIONS

"Office Action of Related U.S. Appl. No. 16/866,553", dated Apr. 20, 2021, pp. 1-17.
"Office Action of Taiwan Related Application No. 109108166", dated Feb. 26, 2021, pp. 1-8.
"Office Action of Related U.S. Appl. No. 17/160,413", dated Aug. 2, 2021, pp. 1-27.
"Office Action of China Related Application No. 202010131136.1", dated Jan. 26, 2022, pp. 1-8.

* cited by examiner

DISPLAY EQUIPMENT AND OPERATION METHOD THEREOF AND BACKLIGHT CONTROL DEVICE THAT SOLVES FLICKER PHENOMENON OF VARIABLE REFRESH RATE VIDEO FRAME

CROSS-REFERENCE TO RELATED APPLICATION

This application claims the priority benefit of China application serial no. 202110710184.0, filed on Jun. 25, 2021. The entirety of the above-mentioned patent application is hereby incorporated by reference herein and made a part of this specification.

BACKGROUND OF THE INVENTION

Field of the Invention

The invention relates to an electronic equipment, and more particularly to a display equipment, an operation method thereof, and a backlight control device.

Description of Related Art

As electronic games are popular all over the world, the demand for e-sports monitors is increasing day by day. The current display panels are mainly divided into three categories: twisted nematic (TN), in-plane switching (IPS), and vertical alignment (VA). Due to the characteristics of fast response time, TN display panels currently have a higher market share in gaming displays, but the colors are not bright enough and the viewing angle is poor. IPS display panels and VA display panels have good colors and large viewing angles, but the disadvantage thereof is that response time is slow. Longer response time is prone to an afterimage phenomenon.

In addition, variable refresh rate (VRR) techniques may be applied to gaming displays. VRR techniques may realize the dynamic change of a vertical synchronization signal (Vsync). Based on the dynamic change of the time length of each frame period, VRR techniques may effectively solve issues such as screen tearing and delay caused by synchronization issues. However, VRR techniques produce inconsistent time length of each frame period, making the display prone to a flicker phenomenon.

SUMMARY OF THE INVENTION

The invention provides a display equipment, an operation method thereof, and a backlight control device to solve the flicker phenomenon of a variable refresh rate (VRR) video frame.

In an embodiment of the invention, a display equipment includes a display panel, a backlight module, an image processing circuit, a panel control circuit, a first backlight control circuit, and a second backlight control circuit. The image processing circuit is configured to provide a video stream, wherein the video stream includes a VRR video frame. The image processing circuit also provides a first timing information about a valid data period of the VRR video frame, and the image processing circuit also provides a second timing information about a blank period of the VRR video frame. The panel control circuit is coupled to the image processing circuit to receive the video stream. The panel control circuit is configured to drive the display panel to display an image according to the VRR video frame. The first backlight control circuit is coupled to the image processing circuit to receive the first timing information. The first backlight control circuit is configured to generate at least one main dimming signal during the valid data period according to the first timing information to drive the backlight module, so that the backlight module provides a main backlight to the display panel during the valid data period. The second backlight control circuit is coupled to the image processing circuit to receive the second timing information. The second backlight control circuit is configured to generate at least one compensation dimming signal during the blank period according to the second timing information to drive the backlight module, so that the backlight module provides a compensation backlight to the display panel during the blank period. In particular, a peak current value of the at least one compensation dimming signal is less than a peak current value of the at least one main dimming signal.

In an embodiment of the invention, an operation method includes: providing a video stream by an image processing circuit of a display equipment, wherein the video stream includes a VRR video frame; driving a display panel of the display equipment according to the VRR video frame via a panel control circuit of the display equipment to display an image; providing a first timing information about a valid data period of the VRR video frame via the image processing circuit; generating at least one main dimming signal during the valid data period according to the first timing information via a first backlight control circuit of the display equipment to drive a backlight module of the display equipment, so that the backlight module provides a main backlight to the display panel during the valid data period; providing a second timing information about a blank period of the VRR video frame via the image processing circuit; and generating at least one compensation dimming signal via a second backlight control circuit of the display equipment during the blank period according to the second timing information to drive the backlight module, so that the backlight module provides a compensation backlight to the display panel during the blank period. In particular, a peak current value of the at least one compensation dimming signal is less than a peak current value of the at least one main dimming signal.

In an embodiment of the invention, a backlight control device includes an image processing circuit, a first backlight control circuit, and a second backlight control circuit. The image processing circuit is configured to provide a video stream to a panel control circuit, wherein the video stream includes a VRR video frame. The panel control circuit drives a display panel to display an image according to the VRR video frame. The image processing circuit also provides a first timing information about a valid data period of the VRR video frame. The image processing circuit also provides a second timing information about a blank period of the VRR video frame. The first backlight control circuit is coupled to the image processing circuit to receive the first timing information. The first backlight control circuit is configured to generate at least one main dimming signal during the valid data period according to the first timing information to drive a backlight module, so that the backlight module provides a main backlight to the display panel during the valid data period. The second backlight control circuit is coupled to the image processing circuit to receive the second timing information. The second backlight control circuit is configured to generate at least one compensation dimming signal during the blank period according to the second timing information to drive the backlight module, so that the backlight module provides a compensation backlight to the display panel during the blank period. In particular, a peak current value of the at least one compensation dimming signal is less than a peak current value of the at least one main dimming signal.

Based on the above, the first backlight control circuit of the embodiments of the invention makes the backlight module provide the main backlight to the display panel during the valid data period of the VRR video frame, and the second backlight control circuit makes the backlight module provide the compensation backlight to the display panel during the blank period of the VRR video frame. The average brightness of the compensation backlight during the blank period conforms to the average brightness of the main backlight during the valid data period. That is, the difference between the average brightness of the compensation backlight and the average brightness of the main backlight is within the allowable range according to actual use experience (within an error range that is not easily noticeable by the user). Therefore, the flicker phenomenon of the VRR video frame may be effectively solved. In addition, the peak current value of the compensation dimming signal during the blank period is less than the peak current value of the main dimming signal during the valid data period, so premature aging of the light-emitting elements of the backlight module may be avoided as much as possible.

In order to make the aforementioned features and advantages of the disclosure more comprehensible, embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
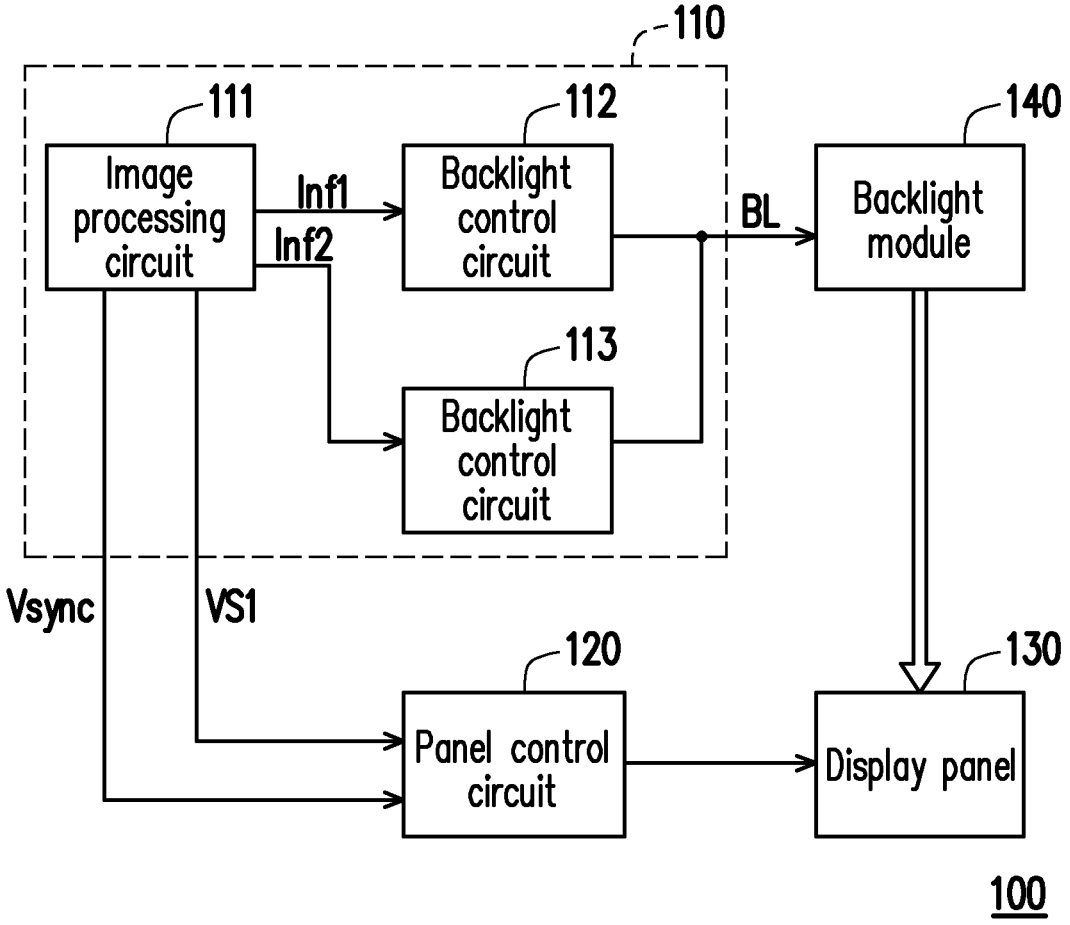
FIG. 1 is a circuit block diagram of a display equipment according to an embodiment of the invention.

The term "coupled to (or connected to)" used in the entire text of the specification of the present application (including claims) may refer to any direct or indirect connecting means. For instance, if the text describes a first device is coupled to (or connected to) a second device, then it should be understood that the first device may be directly connected to the second device, or the first device may be indirectly connected to the second device via other devices or certain connecting means. Terms such as "first" and "second" mentioned in the entire specification of the present application (including the claims) are used to name the elements or to distinguish different embodiments or ranges, and are not used to restrict the upper or lower limits of the number of elements, nor are they used to limit the order of the elements. Moreover, when applicable, elements/components/steps having the same reference numerals in figures and embodiments represent the same or similar parts. Elements/components/steps having the same reference numerals or having the same terminology in different embodiments may be cross-referenced.

FIG. 1 is a circuit block diagram of a display equipment 100 according to an embodiment of the invention. The display equipment 100 shown in FIG. 1 includes a backlight control device 110, a panel control circuit 120, a display panel 130, and a backlight module 140. According to actual design, the display panel 130 may be a liquid-crystal display panel or other display panels, and the light-emitting elements of the backlight module 140 may be light-emitting diodes or other light-emitting elements. According to actual design, the backlight module 140 may be a local dimming backlight module or a global dimming backlight module.

The backlight control device 110 shown in FIG. 1 includes an image processing circuit 111, a backlight control circuit 112 (first backlight control circuit), and a backlight control circuit 113 (second backlight control circuit). The image processing circuit 111 may provide a video stream VS1 to the panel control circuit 120, wherein the video stream VS1 includes one or a plurality of variable refresh rate (VRR) video frames. The present embodiment does not limit the implementation details of the VRR video frame. For example, in some embodiments, the VRR video frame may be a VRR video frame generated by a conventional VRR technique or other VRR techniques. The details of the conventional VRR technique are not repeated herein. The panel control circuit 120 is coupled to the image processing circuit 111 to receive the video stream VS1. The panel control circuit 120 may drive the display panel 130 to display an image according to the VRR video frame.

The display equipment 100 shown in FIG. 1 may be any electronic equipment according to actual design. For example, in some embodiments, the display equipment 100 may be a notebook computer, a tablet computer, an all-in-one (AIO) computer, or other computer equipment. In such an embodiment, the image processing circuit 111 may include a graphic processing unit (GPU), a central processing unit (CPU), or other devices that may run VRR techniques to generate the video stream VS1 to the panel control circuit 120.

Figure 2:
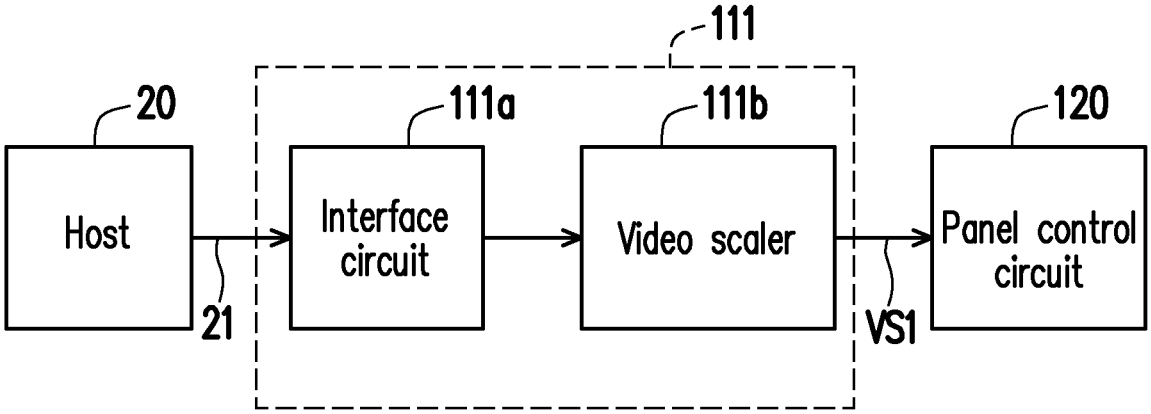
FIG. 2 is a circuit block diagram illustrating the image processing circuit shown in FIG. 1 according to an embodiment of the invention.

In some other embodiments, the display equipment 100 may be a monitor, a head-mounted display (HMD), or other display equipment. FIG. 2 is a circuit block diagram illustrating the image processing circuit 111 shown in FIG. 1 according to an embodiment of the invention. A host 20 shown in FIG. 2 may run VRR techniques and output an original VRR stream 21. In the embodiment shown in FIG. 2, the image processing circuit 111 includes an interface circuit 111*a*. The interface circuit 111*a* may receive the original VRR stream 21 from the host 20. According to actual design, the interface circuit 111*a* may include a universal serial bus (USB) interface circuit, a high-definition multimedia interface (HDMI) circuit, a display port (DP) interface circuit, or other video data transmission interface circuits.

The image processing circuit 111 may also include a video scaler 111*b* or other video processing devices. The video scaler 111*b* shown in FIG. 2 is coupled to the interface circuit 111*a* to receive the original VRR stream 21. The video scaler 111*b* may adjust the resolution of the original VRR stream 21 to generate the video stream VS1 to the panel control circuit 120. According to actual design, in some embodiments, the video scaler 111*b* may include a conventional scaler circuit or other scaler circuits.

Figure 3:
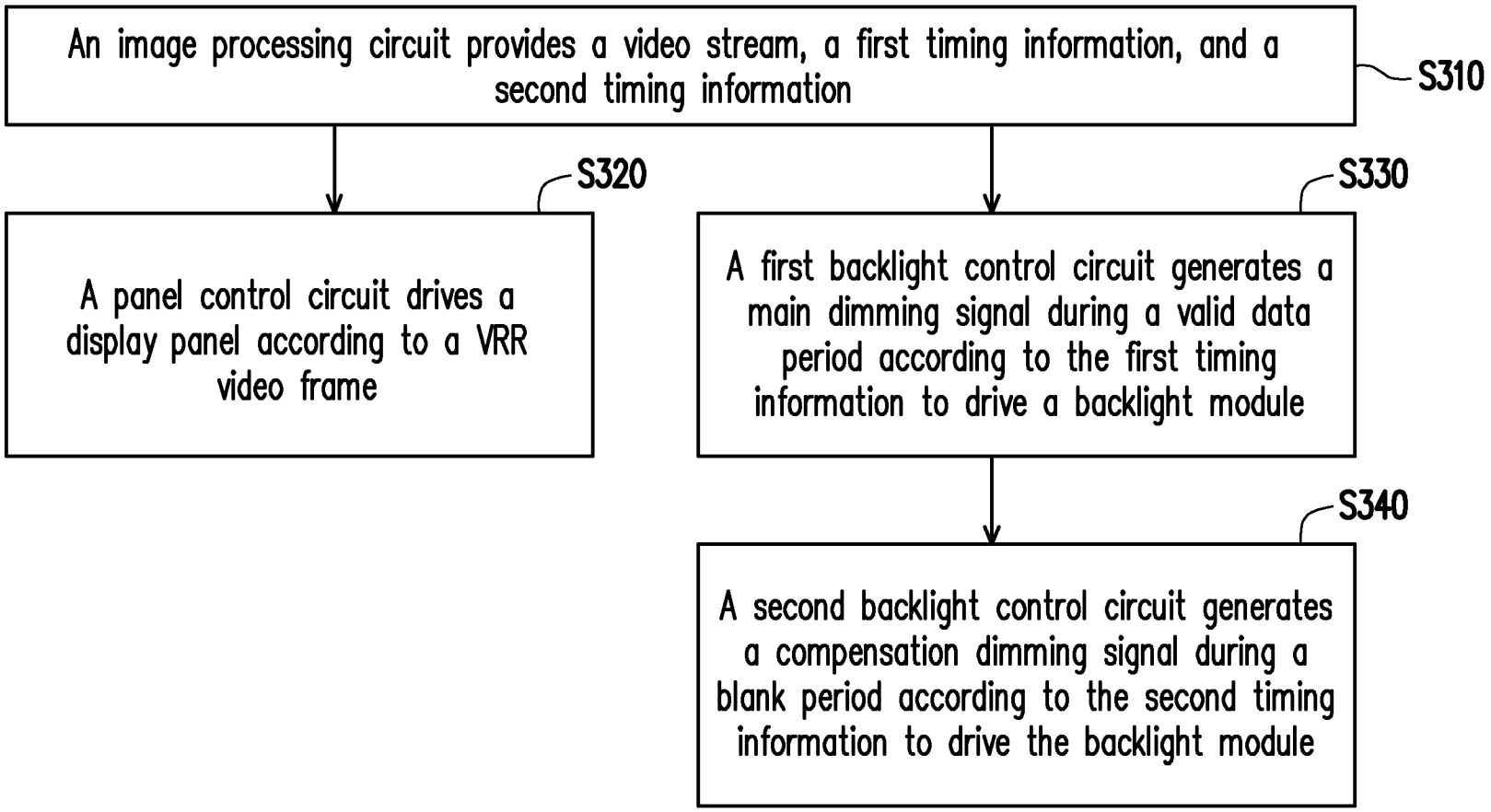
FIG. 3 is a flowchart of an operation method of a display equipment according to an embodiment of the invention.

FIG. 3 is a flowchart of an operation method of a display equipment according to an embodiment of the invention. Please refer to FIG. 1 and FIG. 3. The image processing circuit 111 provides the video stream VS1, a timing information Inf1 (first timing information), and a timing information Inf2 (second timing information) to the panel control circuit 120, the backlight control circuit 112 (first backlight control circuit), and the backlight control circuit 113 (second backlight control circuit) in step S310. In particular, the timing information Inf1 is information (or configuration parameters) about the valid data period of the VRR video frame, and the timing information Inf2 is information (or configuration parameters) about the blank period of the VRR video frame.

In step S320, the panel control circuit 120 may drive the display panel 130 to display an image according to the VRR video frame of the video stream VS1. The backlight control circuit 112 is coupled to the image processing circuit 111 to receive the timing information Inf1. The backlight control circuit 112 may generate one or a plurality of main dimming signals to the backlight module 140 during the valid data period of the VRR video frame according to the timing information Inf1 (step S330). The main dimming signal may drive the backlight module 140 in step S330, so that the backlight module 140 provides a main backlight to the display panel 130 during the valid data period of the VRR video frame. The backlight control circuit 113 is coupled to the image processing circuit 111 to receive the timing information Inf2. The backlight control circuit 113 may generate one or a plurality of compensation dimming signals to the backlight module 140 during the blank period of the VRR video frame according to the timing information Inf2 (step S340). The compensation dimming signal may drive the backlight module 140 in step S340, so that the backlight module 140 provides a compensation backlight to the display panel 130 during the blank period of the VRR video frame. In particular, a peak current value of the compensation dimming signal is less than a peak current value of the main dimming signal.

The image processing circuit 111 and the backlight control circuit 112 may individually determine the turn-on time (i.e., light-emitting time) of the corresponding one of a plurality of light-emitting zones of the backlight module 140 by controlling the light-emitting elements (such as light-emitting diodes) of the backlight module 140 with a plurality of consecutive pulses according to the response time of the display panel 130 and the writing period of the target display area, and generate the timing information Inf1 according to the turn-on times. In particular, the plurality of consecutive pulses may be generated according to a pulse-width modulation (PWM) signal, for example. At the same time, the image processing circuit 111 may also divide one frame into multiple levels according to the degree of brightness/darkness of the content of the frame data, and then determine the size of the average drive current of each light-emitting zone according to the level corresponding to each light-emitting zone in the backlight module 140. According to actual design, the panel control circuit 120 may include a timing controller, a gate driver, and/or a source driver. The panel control circuit 120 determines the control voltage according to the frame data, and changes the degree of distortion of liquid crystal molecule arrangement in the display panel 130 (in response to the control voltage), thereby displaying different grayscales. The following uses FIG. 4 to illustrate, in global dimming smart backlight control (GDSBC) mode, how the control circuit 110 controls the turn-on time interval of the backlight module 140 according to the response time of the display panel 130 and the writing period of the target display area.

Figure 4:
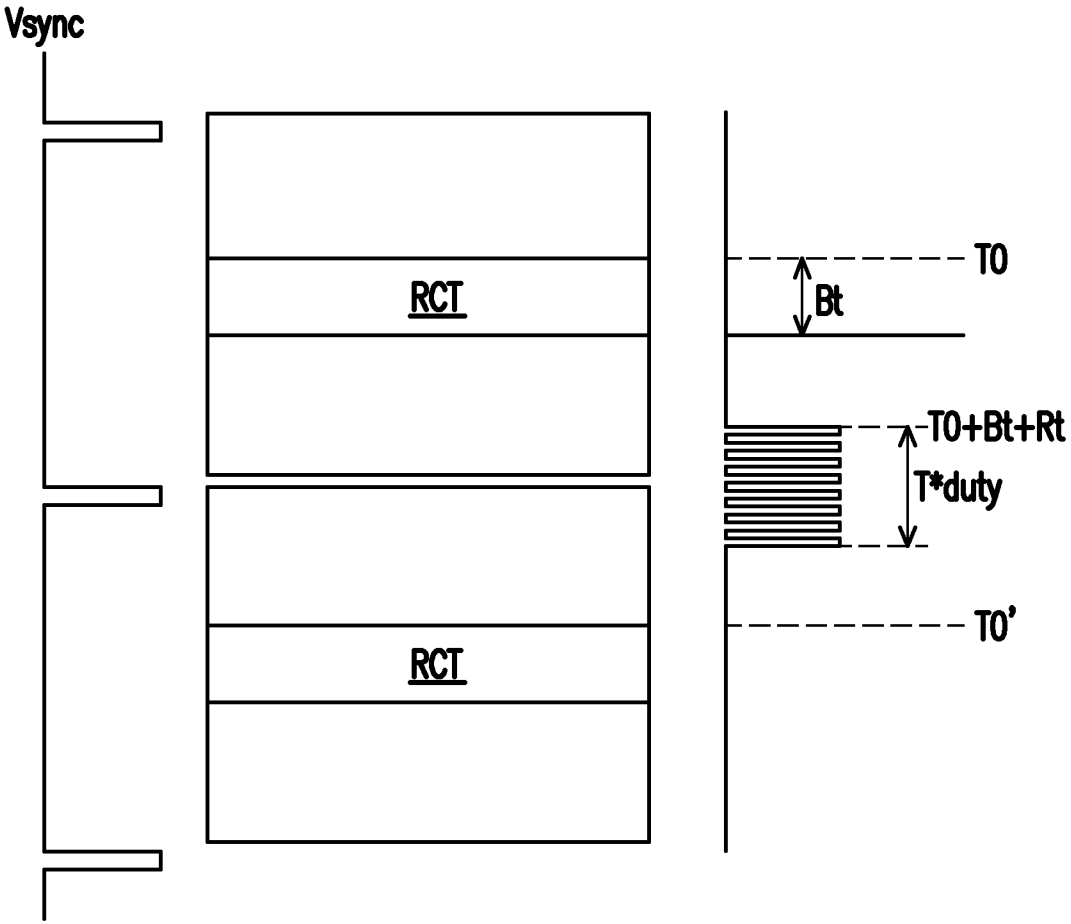
FIG. 4 is a schematic diagram of driving a backlight module in GDSBC mode by a backlight control circuit according to an embodiment of the invention.

FIG. 4 is a schematic diagram of driving the backlight module 140 in GDSBC mode by the backlight control circuit 112 according to an embodiment of the invention. Please referring to all of FIG. 1 to FIG. 4. T0 represents the time point at which a central display area RCT of the target display area of the display panel 130 starts to be refreshed. Bt represents the time length needed to refresh the entire central display area RCT. Rt represents the response time needed for the liquid crystal molecules of the display panel 130 to deflect. T represents the time interval length between two vertical synchronization signals Vsync. In order to ensure the best display effect of the central display area RCT of the display panel 130, the image processing circuit 111 may determine the time point for turning on the backlight module 140 as T0+Bt+Rt. If T0+Bt+Rt is greater than T, it means that the backlight module 140 is turned on during the display period of the next frame, and the time point of turn-on is T0+Bt+Rt−T. Since the backlight needs to be turned off before the central display area RCT is refreshed again (that is, before a time point T0'), the relationship between the central display area RCT and a turn-on time T*duty of the backlight module 140 (that is, the duration of a plurality of consecutive pulses) may be expressed as formula (1):

$$T0+Bt+Rt+T*\text{duty}=T0+T \qquad \text{formula (1)}$$

For example, it is assumed that the current update rate of the display equipment 100 is 144 Hz, and a time length T of updating one frame is about 6.9 ms. Moreover, it is assumed that a response time Rt of the display panel 130 may be reduced from 14 ms to 5 ms via a driving technique, and the duty ratio "duty" is set to 10% within the minimum brightness specification. After substituting the above values into formula (1), it may be concluded that a time length Bt is equal to 6.9-5-0.69, which is 1.21 ms. To ensure that the effect of the central display area RCT is clear, a time point T0 is equal to T/2−Bt/2, which is about 2.8 ms.

It may be known from formula (1) that the smaller the response time Rt and the smaller the turn-on time T*duty, the larger the central display area RCT that may be obtained. In other words, the size of the central display area RCT is inversely proportional to the sum of the response time Rt of the display panel 130 and the turn-on time T*duty of the backlight module 140. However, the continuous reduction of the response time Rt and the turn-on time T*duty causes distortion of screen color and loss of brightness, so a balance between the values needs be achieved to produce the best screen effect. When the brightness of the backlight module 140 is greater than or equal to the specified brightness, the central display area RCT and the response time Rt do not have to be adjusted. However, when the brightness of the backlight module 140 is less than the specified brightness, the turn-on time T*duty of the backlight module 140 may be increased by reducing the size of the central display area RCT or increasing drive current.

Figure 5:
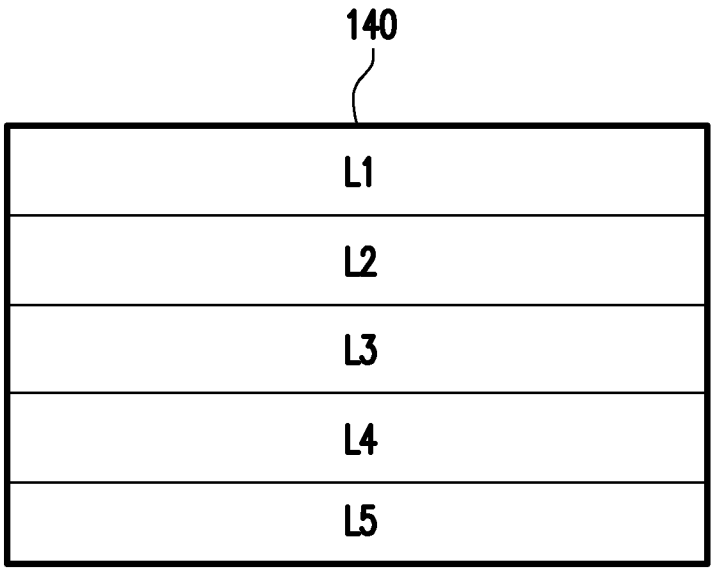
FIG. 5 is a schematic diagram of partitions of a backlight module in LDSBC mode according to an embodiment of the invention.

FIG. 5 is a schematic diagram of partitions of the backlight module 140 in local dimming smart backlight control (LDSBC) mode according to an embodiment of the invention. Referring to FIG. 1 and FIG. 5, in the present embodiment, the backlight module 140 is, for example, an area dimming backlight module. That is, the backlight module 140 may be divided into a plurality of light-emitting zones L1 to L5, and the display panel 130 is also divided into a plurality of target display areas. It is assumed that the display panel 130 is scanned from top to bottom, and the liquid crystal starts to flip after scanning. When the liquid crystal in the target display area corresponding to the light-emitting zone L1 is completely flipped, the backlight control circuit 112 may output a plurality of consecutive pulses to light up the backlight of the light-emitting zone L1. When the liquid crystal of the target display area corresponding to the light-emitting zone L2 is flipped, the backlight control circuit 112 may light up the backlight of the light-emitting zone L2. By analogy, the backlight control circuit 112 may light up the backlights of the light-emitting zone L1 to the light-emitting zone L5 one by one. Therefore, the backlight control device 110 may eliminate afterimage caused by the slow deflection of the liquid crystal, and the screen that the user sees is always the clearest.

Figure 6:
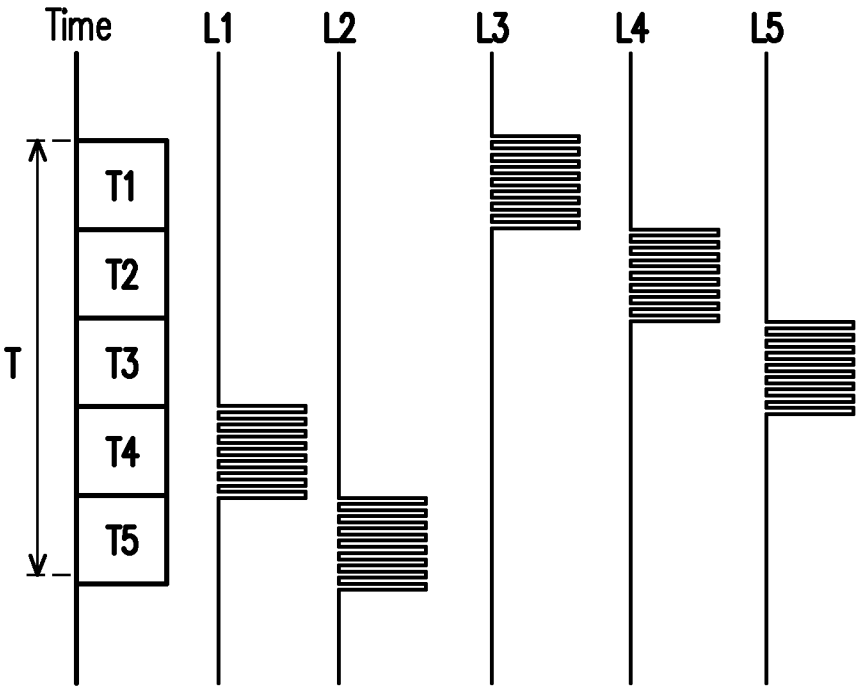
FIG. 6 is a schematic diagram of driving a backlight module in LDSBC mode by a backlight control circuit according to another embodiment of the invention.

FIG. 6 is a schematic diagram of driving the backlight module 140 in LDSBC mode by the backlight control circuit 112 according to another embodiment of the invention. Please refer to FIG. 1, FIG. 5, and FIG. 6. In the present embodiment, in the case that the display panel 130 is scanned from top to bottom, the target display area corresponding to the light-emitting zone L1 completes the screen update at a time T1, and the light-emitting zone L1 is turned on at a time T4 after the corresponding liquid crystal is completely flipped (passing a time T2 and a time T3) (the backlight of the light-emitting zone L1 is lit). The target display area corresponding to the light-emitting zone L2 completes the screen update at the time T2, and the light-emitting zone L2 is turned on at a time T5 after the corresponding liquid crystal is completely flipped (the backlight of the light-emitting zone L2 is lit). The turn-on times of the light-emitting zones L3 to L5 may be deduced by analogy by referring to the related descriptions of the light-emitting zones L1 and L2, but the turn-on times of the light-emitting zones L3 to L5 are in the next frame period.

According to the above, the image processing circuit 111 may first calculate the number of partitions (that is, the target display area of the liquid crystal display panel 130). It is assumed that the number of partitions is N, and N is a positive integer. The time when the backlight module 140 is turned on is T*duty. The time for each partition to finish scanning is T/N ms. The time for each light-emitting zone (such as L1 to L5) from the start of the screen update to turning on is (T/N+Rt) ms. The continuous turn-on time of each of the light-emitting zones L1 to L5 is (T*duty)/N ms. In order to ensure that the screens seen by the user are all the clearest, the corresponding light-emitting zones L1 to L5 should be turned off before the corresponding target display area is scanned in the next frame, and therefore T/N+Rt+(T*duty)/N<T, and the derivation result is as formula (2):

$$N>(T+T^{*}\text{duty})/(T-Rt) \qquad \text{formula (2)}$$

The values of T, Rt, and "duty" are determined according to actual design, and the minimum number of partitions N may be calculated by formula (2). Once the number of partitions N is determined, the turn-on times of the light-emitting zones (such as L1 to L5) of each area is determined to be an integer multiple of T/N. In the case that the x-th target display area is updated, and the time to start the update is (x−1)*T/N, a time Ton when the liquid crystal deflection of the x-th target display area is completed (that is, the time when the x-th light-emitting zone is turned on) is formula (3). If Ton is greater than T, the backlight of the x-th light-emitting zone is turned on at the time of Ton-T in the next screen update.

$$\text{Ton}=(x-1)^{*}T/N+T/N+Rt \qquad \text{formula (3)}$$

For example, the image processing circuit 111 may set the response time Rt of the display panel 130 to an acceptable range of the screen effect via a driving technique. That is, the response time Rt of the display panel 130 may be less than the time T for updating one frame. In the case that the current update rate of the display panel 130 is 144 hertz (Hz), the time to update one frame is about 6.9 ms, and the original response time Rt of the display panel 130 is 14 milliseconds (ms), which may be reduced to about 5 ms via a driving technique. The duty cycle "duty" is set to 30% in the minimum brightness specification, and substituting "duty" into formula (2), the minimum value of N is obtained to be 5. If every frame starts to be updated in the first target display area, then the time for the first light-emitting zone to be turned on is Ton=(x−1)*T/N+T/N+Rt=6.38 ms.

The plurality of embodiments above may reduce the issue of screen afterimage. A variable refresh rate (VRR) technique may be applied to the display equipment 100. The VRR technique may achieve the dynamic change of a vertical synchronization signal (Vsync). That is, the time length of each frame (VRR video frame) may be dynamically changed. Based on the dynamic change of the time length of each frame period, the VRR technique may effectively solve issues such as screen tearing and delay caused by synchronization issues. However, the VRR technique makes the time length of each frame period not fixed, and as a result the average brightness of each frame period may be different from each other, such that flicker phenomenon is prone to occur. In order to effectively solve the flicker phenomenon of the VRR video frame, the display equipment 100 may run the operation method shown in FIG. 3.

Figure 7:
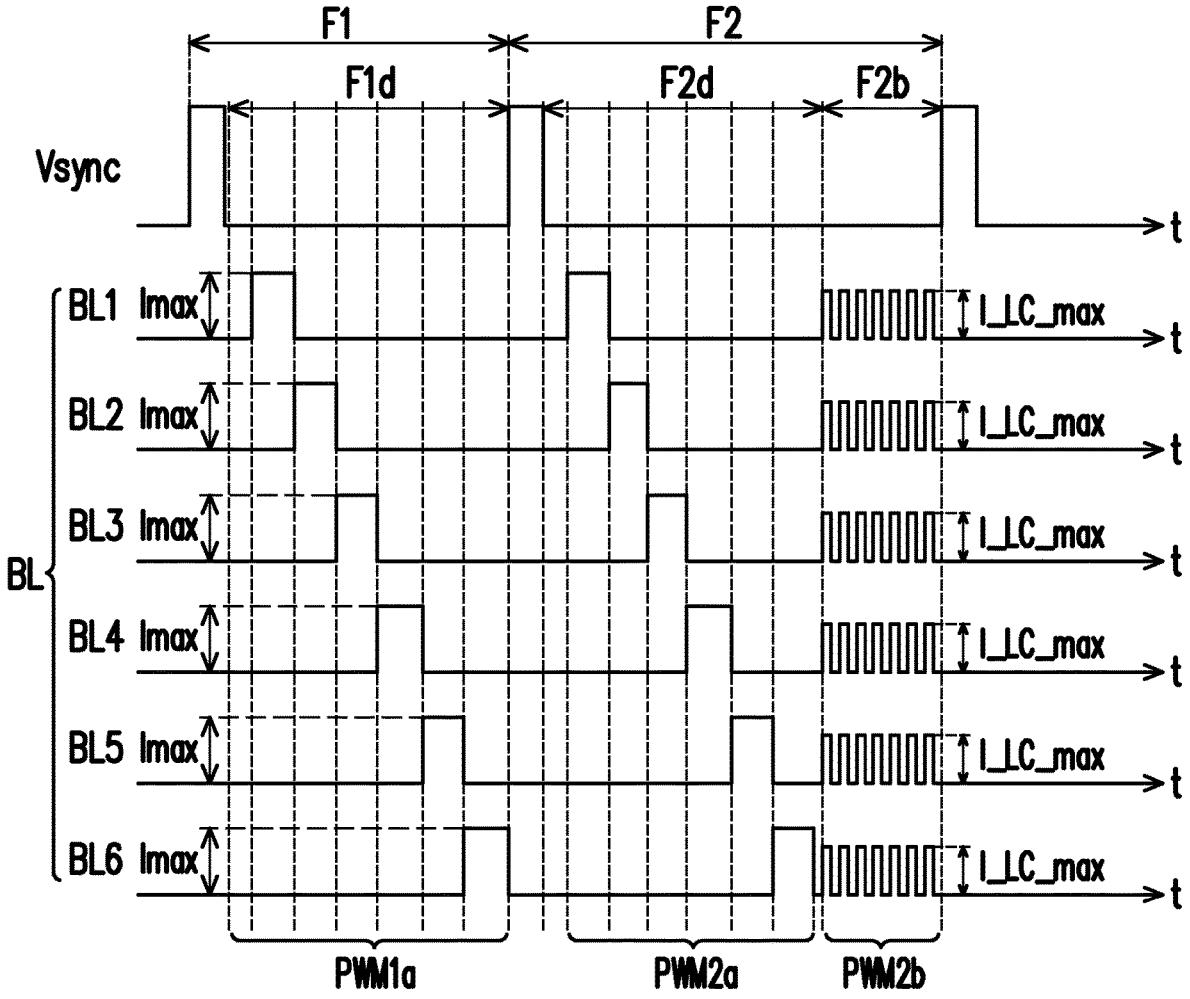
FIG. 7 is a schematic diagram illustrating the waveforms of a vertical synchronization signal (Vsync) and a drive current (dimming signal) BL shown in FIG. 1 according to an embodiment of the invention.

FIG. 7 is a schematic diagram illustrating the waveforms of the vertical synchronization signal (Vsync) and the drive current (dimming signal) BL shown in FIG. 1 according to an embodiment of the invention. The drive current BL shown in FIG. 7 includes drive currents BL1, BL2, BL3, BL4, BL5, and BL6, and the drive currents BL1 to BL6 are respectively used to drive 6 light-emitting zones of the backlight module 140. In the embodiment shown in FIG. 7, the horizontal axis represents a time t. Based on the definition of the vertical synchronization signal Vsync, the video stream VS1 includes a VRR video frame F1 and a VRR video frame F2. Based on VRR techniques, the time lengths of the VRR video frames F1 and F2 may be different from each other. Each of the VRR video frames F1 and F2 may include a valid data period and a blank period. For example, the VRR video frame F2 includes a valid data period F2*d* and a blank period F2*b*. The VRR video frame F1 includes a valid data period F1*d* and a blank period, wherein the blank period of the VRR video frame F1 shown in FIG. 7 is very small (even the time length of the blank period may be 0), and therefore no reference numerals are assigned.

Please refer to FIG. 1, FIG. 3, and FIG. 7. The image processing circuit 111 may output a frame data (pixel data) to the panel control circuit 120 during the valid data period of the VRR video frames F1 and F2. For example, the image processing circuit 111 may output a frame data to the panel control circuit 120 during the valid data period F1*d* of the VRR video frame F1, and output a frame data to the panel control circuit 120 during the valid data period F2*d* of the VRR video frame F2. Therefore, in step S320, the panel control circuit 120 may drive the display panel 130 to display an image according to the VRR video frame of the video stream VS1. The time lengths of the valid data periods F1*d* and F2*d* of the VRR video frames F1 and F2 are about the same as each other. Based on VRR techniques, the time lengths of the blank periods of the VRR video frames F1 and F2 may be different from each other.

In the VRR video frame F1, the drive current (dimming signal) BL shown in FIG. 7 includes a main dimming signal PWM1*a*. The backlight control circuit 112 may generate a plurality of (or one) main dimming signals PWM1*a* to the backlight module 140 during the valid data period F1*d* of the VRR video frame F1 according to the timing information Inf1 (step S330). The main dimming signal PWM1*a* may drive different light-emitting zones of the backlight module 140 in step S330, so that the backlight module 140 provides a main backlight to the display panel 130 during the valid data period F1*d* of the VRR video frame F1. In the same way, in the VRR video frame F2, the drive current (dimming signal) BL shown in FIG. 7 includes a main dimming signal PWM2*a* and a compensation dimming signal PWM2*b*. The backlight control circuit 112 may generate a plurality of (or one) main dimming signals PWM2*a* to the backlight module 140 during the valid data period F2*d* of the VRR video frame F2 according to the timing information Inf1. The driving operation of the backlight module 140 by the backlight control circuit 112 during the valid data periods F1*d* and F2*d* may be deduced by analogy with reference to the related descriptions of FIG. 4 to FIG. 6, and therefore is not repeated herein.

The backlight control circuit 113 may generate one or a plurality of compensation dimming signals to the backlight module 140 during the blank period of the VRR video frame according to the timing information Inf2 (step S340). For example, the backlight control circuit 113 may generate the compensation dimming signal PWM2*b* during the blank period F2*b* of the VRR video frame F2 to different light-emitting zones of the backlight module 140. In this way, the backlight module 140 provides a compensation backlight to the display panel 130 during the blank period F2*b* of the VRR video frame F2. In particular, a peak current value I_LC_max of the compensation dimming signal PWM2*b* is less than a peak current value Imax of the main dimming signal PWM2*a*, and therefore the embodiment shown in FIG. 7 may prevent premature aging of the light-emitting elements of the backlight module 140 as much as possible.

In the embodiment shown in FIG. 7, the duty ratio of the main dimming signal PWM2*a* during the valid data period F2*d* is less than the duty ratio of the compensation dimming signal PWM2*b* during the blank period F2*b*. In this way, the average brightness of the compensation backlight provided by the backlight module 140 during the blank period F2*b* conforms to the average brightness of the main backlight provided by the backlight module 140 during the valid data period F2*d*. That is, the difference between the average brightness of the compensation backlight and the average brightness of the main backlight is within the allowable range according to actual use experience (within an error range that is not easily noticeable by the user).

For example, the peak current value I_LC_max of the compensation dimming signal PWM2*b* is less than the peak current value Imax of the main dimming signal PWM2*a*, and the duty ratio of the compensation dimming signal PWM2*b* is greater than or equal to 1/n (assuming that the backlight module 140 is divided into n light-emitting zones, that is, the drive current BL includes n drive currents BL1 to BLn). In this way, the average brightness (average current) of the compensation dimming signal PWM2*b* is consistent with the average brightness (average current) of the main dimming signal PWM2*a*. According to the average current formula $$I_{avg} = \frac{1}{T} * \int_0^T f(I)dt,$$

the average current $I_{avg}$(F2*d*)=Imax*Duty1=Imax*1/n during the valid data period F2*d*, and the average current $I_{avg}$(F2*b*)=I_LC_max*Duty2 during the blank period F2*b*. In particular, Duty1 is the duty ratio of any main dimming signal PWM2*a*, n is the number of light-emitting zones of the backlight module 140, and Duty2 is the duty ratio of the compensation dimming signal PWM2*b*. As long as $I_{avg}$(F2*d*)=$I_{avg}$(F2*b*), that is, Imax*Duty1=I_LC_max*Duty2, the average currents (average brightnesses) of the valid data period F2*d* and the blank period F2*b* of each light-emitting zone may be ensured to be consistent with each other, so that there is no flicker phenomenon.

The embodiment shown in FIG. 7 uses a pulse-width modulation (PWM) technique to implement the compensation dimming signal PWM2*b* of the embodiment shown in FIG. 7. However, in other embodiments, the compensation dimming signal PWM2*b* may be a DC signal (or, in other words, the duty ratio of the compensation dimming signal PWM2*b* during the blank period F2*b* is 100%). In the case that the peak current value of the main dimming signal PWM2*a* is Imax, the current level I_LC_max of the compensation dimming signal PWM2*b* (DC signal) may be set to Imax/n (assuming that the backlight module 140 is divided into n light-emitting zones, that is, the drive current BL includes n drive currents BL1 to BLn). According to the average current formula $$I_{avg} = \frac{1}{T} * \int_0^T f(I)dt,$$

the average current $I_{avg}$(F2*d*)=Imax*Duty1=A*1/n during the valid data period F2*d*, and the average current $I_{avg}$(F2*b*)=A*1/n during the blank period F2*b*. In particular, Duty1 is the duty ratio of any main dimming signal PWM2*a*, and n is the number of light-emitting zones of the backlight module 140. As long as $I_{avg}$(F2*b*)A*1/N, the average current (average brightness) of the drive current BL during the blank period F2*b* and the average current (average brightness) of the drive current BL during the valid data period F2*d* may be ensured to be consistent, so that there is no flicker phenomenon.

Figure 8:
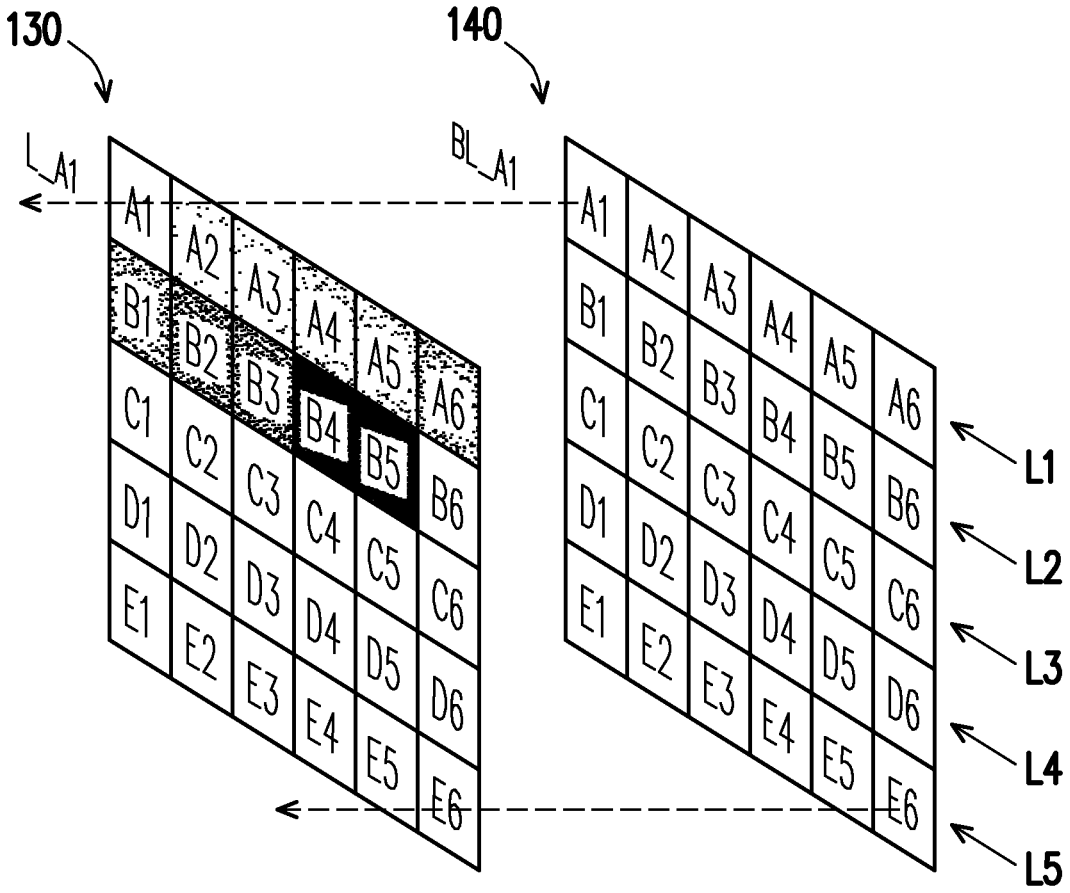
FIG. 8 shows a schematic diagram of an operation situation of a backlight module and a display panel of the invention in LDSBC mode.

FIG. 8 shows a schematic diagram of an operation situation of the backlight module 140 and the display panel 130 of the invention in LDSBC mode. The backlight module 140 shown in FIG. 8 includes the light-emitting zones L1, L2, L3, L4, and L5, and the light-emitting zones L1 to L5 respectively correspond to different target display areas of the display panel 130 shown in FIG. 8. The light-emitting zone L1 shown in FIG. 8 further includes light-emitting zones A1, A2, A3, A4, A5, and A6. By analogy, the light-emitting zone L2 further includes light-emitting zones B1 to B6, the light-emitting zone L3 further includes light-emitting zones C1 to C6, the light-emitting zone L4 further includes light-emitting zones D1 to D6, and the light-emitting zone L5 further includes light-emitting zones E1 to E6.

Figure 9:
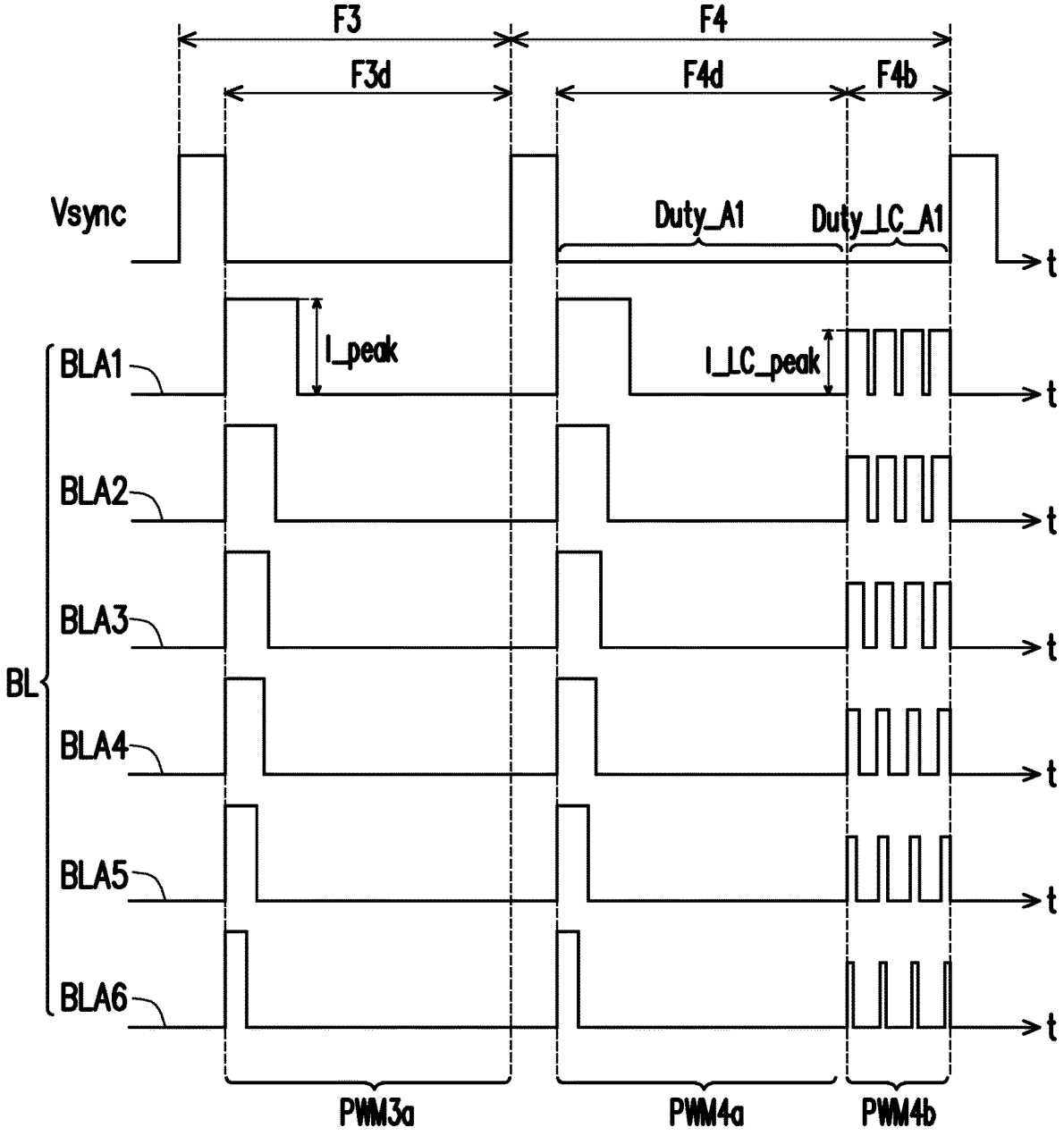
FIG. 9 shows a schematic diagram of a waveform of a drive current of each light-emitting zone of the backlight module shown in FIG. 8.

FIG. 9 shows a schematic diagram of waveforms of a drive current BL of each light-emitting zone of the backlight module 140 shown in FIG. 8. The drive current BL shown in FIG. 9 includes drive currents BLA1, BLA2, BLA3, BLA4, BLA5, and BLA6, and the drive currents BLA1 to BLA6 are respectively used to drive the six light-emitting zones A1 to A6 of the light-emitting zone L1 of the backlight module 140 shown in FIG. 8. The remaining light-emitting zones L2 to L5 of the backlight module 140 shown in FIG. 8 may be deduced by analogy with reference to the related description of the light-emitting zone L1, and therefore are not repeated herein. Please refer to FIG. 1, FIG. 8, and FIG. 9 at the same time. The brightness generated by the light-emitting zone A1 of the backlight module 140 is recorded as BL_A1, and the brightness generated by the light-emitting zone A1 of the display panel 130 is recorded as L_A1, and the rest of the zones may follow this analogy.

In the embodiment shown in FIG. 9, the horizontal axis represents the time t. Based on the definition of the vertical synchronization signal Vsync, the video stream VS1 includes a VRR video frame F3 and a VRR video frame F4. Based on VRR techniques, the time lengths of the VRR video frames F3 and F4 may be different from each other. Each of the VRR video frames F3 and F4 may include a valid data period and a blank period. For example, the VRR video frame F4 includes a valid data period F4*d* and a blank period F4*b*. The VRR video frame F3 includes a valid data period F3*d* and a blank period, wherein the blank period of the VRR video frame F3 shown in FIG. 9 is very small (the time length of the blank period may even be 0), and therefore no reference numerals are assigned.

The frequency of the VRR video frame F3 shown in FIG. 9 is F3_Vsync, and the time length T (the update time of one frame) of the VRR video frame F3 is 1/F3_Vsync. The frequency of the VRR video frame F4 shown in FIG. 9 is F4_Vsync, and the time length T (the update time of one frame) of the VRR video frame F4 is 1/F4_Vsync. The time length T of the VRR video frame F3 may be different from the time length T of the VRR video frame F4. I_peak shown in FIG. 9 represents the peak current value of the drive current in LDSBC mode (unit is mA). The image processing circuit 111 may determine the pulse width of the drive current BLA1 of the zone A1 of the light-emitting zone L1 according to the display data (pixel data) corresponding to the zone A1 shown in FIG. 9. In the present embodiment, since the brightness (grayscale) of the zone A1 is greater than the brightness (grayscale) of the zone A2, the pulse width of the drive current BLA1 of the zone A1 of the light-emitting zone L1 is greater than the pulse width of the drive current BLA2 of the zone A2 of the light-emitting zone L1.

In the VRR video frame F3, the drive current (dimming signal) BL shown in FIG. 9 includes a main dimming signal PWM3*a*. The backlight control circuit 112 may generate a plurality of (or one) main dimming signals PWM3*a* to the backlight module 140 during the valid data period F3*d* of the VRR video frame F3 according to the timing information Inf1 (step S330). The main dimming signal PWM3*a* may drive different zones of the backlight module 140 in step S330, so that the backlight module 140 provides a main backlight to the display panel 130 during the valid data period F3*d* of the VRR video frame F3. For example, the main dimming signal PWM3*a* includes a first zone main signal (the pulse of the drive current BLA1 during the valid data period F3*d*) and a second zone main signal (the pulse of the drive current BLA2 during the valid data period F3*d*), wherein the first zone main signal (the drive current BLA1) is suitable for driving the light-emitting zone A1 of the backlight module 140, and the second zone main signal is suitable for driving the light-emitting zone A2 of the backlight module 140. The duty ratio of the first zone main signal during the valid data period F3*d* is different from the duty ratio of the second zone main signal during the valid data period F3*d*.

In the same way, in the VRR video frame F4, the drive current (dimming signal) BL shown in FIG. 9 includes a main dimming signal PWM4*a* and a compensation dimming signal PWM4*b*. The backlight control circuit 112 may generate a plurality of (or one) main dimming signals PWM4*a* to the backlight module 140 during the valid data period F4*d* of the VRR video frame F4 according to the timing information Inf1. For example, the main dimming signal PWM4*a* includes a first zone main signal (pulse of the drive current BLA1 during the valid data period F4*d*) and a second zone main signal (pulse of the drive current BLA2 during the valid data period F4*d*). The duty ratio of the first zone main signal during the valid data period F4*d* is different from the duty ratio of the second zone main signal during the valid data period F4*d*.

A peak current value I_LC_peak of the compensation dimming signal PWM4*b* is less than a peak current value I_peak of the main dimming signal PWM4*a*, and therefore the embodiment shown in FIG. 9 may prevent premature aging of the light-emitting elements of the backlight module 140 as much as possible. The compensation dimming signal PWM4*b* includes a first zone compensation signal (the pulse of the drive current BLA1 during the blank period F4*b*) and a second zone compensation signal (the pulse of the drive current BLA2 during the blank period F4*b*). The first zone compensation signal is suitable for driving the light-emitting zone A1 of the backlight module 140. The second zone compensation signal is suitable for driving the light-emitting zone A2 of the backlight module 140. The duty ratio of the first zone main signal (the pulse of the drive current BLA1 during the valid data period F4*d*) during the valid data period F4*d* is less than the duty ratio of the first zone compensation signal (the pulse of the drive current BLA1 during the blank period F4*b*) during the blank period F4*b*, so that the average brightness of the light-emitting zone A1 during the blank period F4*b* conforms to the average brightness of the light-emitting zone A1 during the valid data period F4*d*. That is, the difference between the average brightness of the light-emitting zone A1 during the blank period F4*b* and the average brightness of the light-emitting zone A1 during the valid data period F4*d* is within the allowable range according to actual use experience (within an error range that is not easily noticeable by the user).

For example, taking the light-emitting zone A1 as an illustrative example, the average current value of the drive current BLA1 during the valid data period F4*d* is I_peak*Duty_A1, wherein Duty_A1 is the duty ratio of the drive current BLA1 during the valid data period F4*d*. The average current value of the drive current BLA1 during the blank period F4*b* is I_LC_peak*Duty_LC_A1, wherein Duty_LC_A1 is the duty ratio of the drive current BLA1 during the blank period F4*b*. As long as I_peak*Duty_A1=I_LC_peak*Duty_LC_A1, there is no flicker phenomenon. The other drive currents BLA2 to BLA6 shown in FIG. 9 may be deduced by analogy with reference to the relevant description of the drive current BLA1, and are therefore not repeated herein.

The duty ratio of the drive current BLA2 during the valid data period F4*d* is less than the duty ratio of the drive current BLA2 during the blank period F4*b*. Therefore, the average brightness of the light-emitting zone A2 during the blank period F4*b* matches the average brightness of the light-emitting zone A2 during the valid data period F4*d*. The other drive currents BLA2 to BLA6 shown in FIG. 9 may be deduced by analogy with reference to the relevant description of the drive current BLA1, and are therefore not repeated herein.

Figure 10:
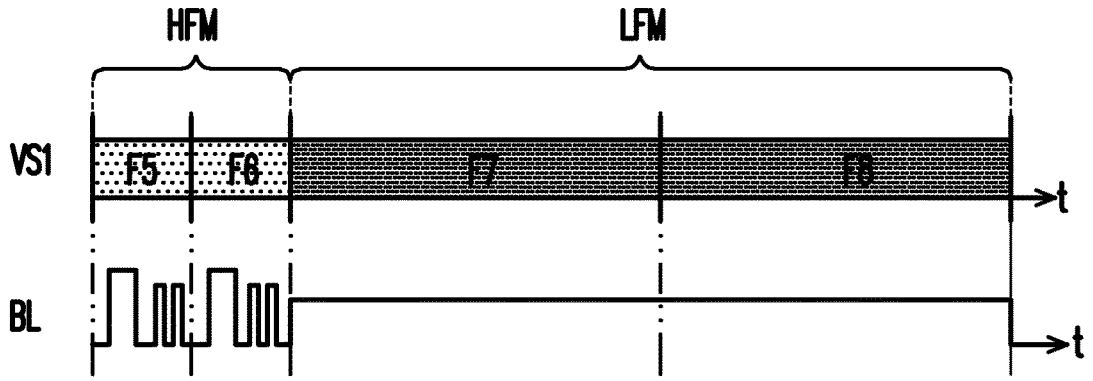
FIG. 10 is a schematic diagram illustrating a waveform of a drive current of each light-emitting zone of a backlight module when a frame rate of a video stream is switched from a high-frequency mode to a low-frequency mode according to an embodiment of the invention.

When the display equipment 100 is operated in the VRR mode shown in FIG. 7 or FIG. 9, when the frequency of the video stream VS1 (vertical synchronization signal Vsync) is too low (for example, 80 Hz), a flicker issue may occur. FIG. 10 is a schematic diagram illustrating a waveform of the drive current BL of each light-emitting zone of the backlight module 140 when a frame rate of the video stream VS1 is switched from a high-frequency mode HFM to a low-frequency mode LFM according to an embodiment of the invention. In the embodiment shown in FIG. 10, the horizontal axis represents the time t. FIG. 10 shows video frames F5, F6, F7, and F8, wherein the video frames F5 and F6 belong to the high-frequency mode HFM, and the video frames F7 and F8 belong to the low-frequency mode LFM. The video frames F5 and F6 shown in FIG. 10 may be deduced by analogy with the related descriptions of the VRR video frames F1 and F2 shown in FIG. 7 or the VRR video frames F3 and F4 shown in FIG. 9, and are therefore not repeated herein.

Please refer to FIG. 10. After the frame rate of the video stream VS1 (the frequency of the vertical synchronization signal Vsync) is switched from the high-frequency mode HFM to the low-frequency mode LFM, the backlight control circuit 112 and the backlight control circuit 113 may drive the backlight module 140 in the low-frequency mode LFM. In this way, the backlight module 140 provides a normal backlight to the display panel 130 during the valid data period and the blank period. In the low-frequency mode LFM, the backlight control circuit 112 and the backlight control circuit 113 drive the backlight module 140 in a pulse-width modulation (PWM) mode or a DC dimming mode. According to design requirements, in other embodiments, the driving method of the backlight module 140 in the low-frequency mode LFM may be a conventional backlight driving method or other driving methods. The embodiment shown in FIG. 10 may effectively prevent the occurrence of flicker.

Figure 11:
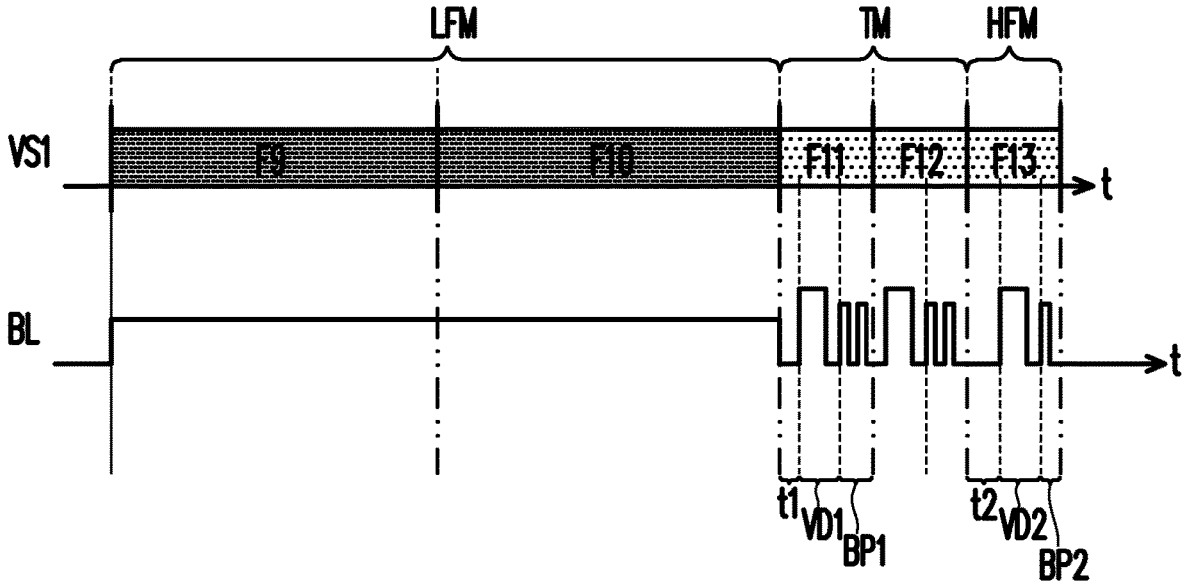
FIG. 11 is a schematic diagram illustrating a waveform of a drive current of each light-emitting zone of a backlight module when a frame rate of a video stream is switched from a low-frequency mode to a high-frequency mode according to an embodiment of the invention.

When the update frequency is operated at a low frequency, the human eye is particularly sensitive to instantaneous changes due to the long compensation time. When the human eye adapts to the current compensation signal, when the VRR mode is re-entered, the human eye is likely to detect sudden brightness changes. FIG. 11 is a schematic diagram illustrating a waveform of the drive current BL of each light-emitting zone of the backlight module 140 when a frame rate of the video stream VS1 is switched from the low-frequency mode LFM to the high-frequency mode HFM according to an embodiment of the invention. In the embodiment shown in FIG. 11, the horizontal axis represents the time t. FIG. 11 shows video frames F9, F10, F11, F12, and F13, wherein the video frames F9 and F10 belong to the low-frequency mode LFM, the video frames F11 and F12 belong to a transition mode TM, and the video frame F13 belongs to the high-frequency mode HFM. The video frames F9 and F10 shown in FIG. 11 may be deduced by analogy with reference to the related descriptions of the video frames F7 and F8 shown in FIG. 10, and the video frame F13 shown in FIG. 11 may be deduced by analogy with reference to the related descriptions of the VRR video frames F1 and F2 shown in FIG. 7 or the VRR video frames F3 and F4 shown in FIG. 9, and are therefore not repeated herein.

Please refer to FIG. 11. The frame rate of the video stream VS1 (the frequency of the vertical synchronization signal Vsync) is switched from the low-frequency mode LFM to the transition mode TM and then to the high-frequency mode HFM. In the low-frequency mode LFM, the backlight control circuit 112 and the backlight control circuit 113 drive the backlight module 140 to provide a normal backlight to the display panel 130 during the valid data period and the blank period. In the transition mode TM, the backlight control circuit 112 and the backlight control circuit 113 prevent the backlight module 140 from emitting light during a first period t1 of the valid data period. The backlight control circuit 112 makes the backlight module 140 provide a main backlight to the display panel 130 during a second period VD1 of the valid data period, and the backlight control circuit 113 makes the backlight module 140 provide a compensation backlight to the display panel 130 during a blank period BP1. The driving operation of the backlight module 140 during the second period VD1 shown in FIG. 11 may be deduced by analogy with reference to the relevant description of the valid data period F1*d* and the valid data period F2*d* shown in FIG. 7, or deduced by analogy with reference to the relevant description of the valid data period F3*d* and the valid data period F4*d* shown in FIG. 9, and is therefore not repeated herein. The driving operation of the backlight module 140 during the blank period BP1 shown in FIG. 11 may be deduced by analogy by referring to the related description of the blank period F2*b* shown in FIG. 7 or the blank period F4*b* shown in FIG. 9, and is therefore not repeated herein.

In the high-frequency mode HFM, the backlight control circuit 112 and the backlight control circuit 113 prevent the backlight module 140 from emitting light during a third period t2 of the valid data period. The backlight control circuit 112 causes the backlight module 140 to provide a main backlight to the display panel 130 during a fourth period VD2 of the valid data period. The backlight control circuit 113 makes the backlight module 140 provide the compensation backlight to the display panel 130 during a blank period BP2. The time length of the first period t1 is less than the time length of the third period t2. The driving operation of the backlight module 140 during the fourth period VD2 shown in FIG. 11 may be deduced by analogy with reference to the relevant description of the valid data period F1*d* and the valid data period F2*d* shown in FIG. 7, or deduced by analogy with reference to the relevant description of the valid data period F3*d* and the valid data period F4*d* shown in FIG. 9, and is therefore not repeated herein. The driving operation of the backlight module 140 during the blank period BP2 shown in FIG. 11 may be deduced by analogy by referring to the related description of the blank period F2*b* shown in FIG. 7 or the blank period F4*b* shown in FIG. 9, and is therefore not repeated herein.

The rated frequencies of the low-frequency mode LFM, the transition mode TM, and the high-frequency mode HFM shown in FIG. 11 may be set according to actual design. For example, in some embodiments, the rated frequency (frame rate) of the low-frequency mode LFM may be 60 Hz, and the rated frequency (frame rate) of the transition mode TM and/or the high-frequency mode HFM may be 165 Hz. The transition mode TM shown in FIG. 11 may effectively buffer the changes from low frequency to high frequency, making it almost impossible for the human eye to detect flicker.

Based on the above, the backlight control circuit 112 of the above embodiments makes the backlight module 140 provide the main backlight to the display panel 130 during the valid data period of the VRR video frame, and the backlight control circuit 113 makes the backlight module 140 provide the compensation backlight to the display panel 130 during the blank period of the VRR video frame. The average brightness of the compensation backlight during the blank period conforms to the average brightness of the main backlight during the valid data period. That is, the difference between the average brightness of the compensation backlight and the average brightness of the main backlight is within the allowable range according to actual use experience (within an error range that is not easily noticeable by the user). Therefore, the flicker phenomenon of the VRR video frame may be effectively solved. In addition, the peak current value I_LC_peak of the compensation dimming signal during the blank period is less than the peak current value I_peak of the main dimming signal during the valid data period, so premature aging of the light-emitting elements of the backlight module 140 may be avoided as much as possible.

According to different design requirements, the backlight control device 110, the panel control circuit 120, the image processing circuit 111, and/or the backlight control circuit 112 may be implemented by hardware, firmware, software (i.e., program), or a combination of the three.

In terms of hardware, the backlight control device 110, the panel control circuit 120, the image processing circuit 111, and/or the backlight control circuit 112 may be implemented in a logic circuit on an integrated circuit. Related functions of the backlight control device 110, the panel control circuit 120, the image processing circuit 111, and/or the backlight control circuit 112 may be implemented as hardware using a hardware description language (for example, Verilog HDL or VHDL) or other suitable programming languages. For example, related functions of the backlight control device 110, the panel control circuit 120, the image processing circuit 111, and/or the backlight control circuit 112 may be implemented in one or a plurality of controllers, microcontrollers, microprocessors, application-specific integrated circuits (ASICs), digital signal processors (DSPs), field-programmable gate arrays (FPGAs), and/or various logic blocks, modules, and circuits in other processing units.

In the form of software and/or firmware, the related functions of the backlight control device 110, the panel control circuit 120, the image processing circuit 111, and/or the backlight control circuit 112 may be implemented as programming codes. For example, the backlight control device 110, the panel control circuit 120, the image processing circuit 111, and/or the backlight control circuit 112 are implemented by using a general programming language (such as C, C++, or an assembly language) or other suitable programming languages. The programming code may be recorded/stored in a "non-transitory computer-readable medium". In some embodiments, the non-temporary computer-readable medium includes, for example, a read-only memory (ROM), a tape, a disk, a card, a semiconductor memory, a programmable logic circuit, and/or a storage device. The storage device includes a hard-disk drive (HDD), a solid-state drive (SSD), or other storage devices. A central processing unit (CPU), a controller, a microcontroller, or a microprocessor may read and execute the programming code from the non-temporary computer-readable medium to achieve the related functions of the backlight control device 110, the panel control circuit 120, the image processing circuit 111, and/or the backlight control circuit 112.

Although the invention has been described with reference to the above embodiments, it will be apparent to one of ordinary skill in the art that modifications to the described embodiments may be made without departing from the spirit of the disclosure. Accordingly, the scope of the disclosure is defined by the attached claims not by the above detailed descriptions.

What is claimed is:

1. A display equipment, comprising:

a display panel;

a backlight module comprising a plurality of light emitting elements;

an image processing circuit configured to provide a video stream, wherein the video stream comprises a variable refresh rate (VRR) video frame, the image processing circuit further provides a first timing information during a valid data period of the VRR video frame, and the image processing circuit also provides a second timing information about a blank period of the VRR video frame;

a panel control circuit coupled to the image processing circuit to receive the video stream and configured to drive the display panel to display an image according to the VRR video frame;

a first backlight control circuit coupled to the image processing circuit to receive the first timing information and configured to generate at least one main dimming signal during the valid data period according to the first timing information to drive the backlight module, so that the backlight module provides a main backlight to the display panel during the valid data period; and a second backlight control circuit coupled to the image processing circuit to receive the second timing information and configured to generate at least one compensation dimming signal during the blank period according to the second timing information to drive the backlight module, so that the backlight module provides a compensation backlight to the display panel during the blank period, wherein a peak current value of the at least one compensation dimming signal during the blank period is less than a peak current value of the at least one main dimming signal during the valid data period, wherein a duty ratio of the at least one main dimming signal during the valid data period is less than a duty ratio of the at least one compensation dimming signal during the blank period, so that an average brightness of the compensation backlight during the blank period conforms to an average brightness of the main backlight during the valid data period.

2. The display equipment of claim 1, wherein the image processing circuit comprises:

an interface circuit configured to receive an original VRR stream from a host; and a video scaler coupled to the interface circuit to receive the original VRR stream and configured to adjust a resolution of the original VRR stream to generate the video stream to the panel control circuit.

3. The display equipment of claim 1, wherein the image processing circuit determines a turn-on time of each of a plurality of light-emitting zones of the backlight module according to a response time of the display panel and a writing period of at least one target display area of the display panel, and generates the first timing information according to the turn-on times.

4. The display equipment of claim 3, wherein the backlight module is a local dimming backlight module, and the image processing circuit individually determines a light-emitting time of a corresponding one in a plurality of light-emitting zones of the backlight module according to the response time of the display panel and a plurality of writing periods of a plurality of target display areas of the display panel.

5. The display equipment of claim 1, wherein the backlight module is a local dimming backlight module, the at least one main dimming signal comprises a first zone main signal and a second zone main signal, the first zone main signal is suitable for driving a first light-emitting zone of the backlight module, the second zone main signal is suitable for driving a second light-emitting zone of the backlight module, and a first duty ratio of the first zone main signal during the valid data period is different from a second duty ratio of the second zone main signal during the valid data period.

6. The display equipment of claim 5, wherein the at least one compensation dimming signal comprises a first zone compensation signal and a second zone compensation signal, the first zone compensation signal is suitable for driving the first light-emitting zone, the second zone compensation signal is suitable for driving the second light-emitting zone, the first duty ratio is less than a third duty ratio of the first zone compensation signal during the blank period so that an average brightness of the first light-emitting zone during the blank period conforms to an average brightness of the first light-emitting zone during the valid data period, and the second duty ratio is less than a fourth duty ratio of the second zone compensation signal during the blank period so that an average brightness of the second light-emitting zone during the blank period conforms to an average brightness of the second light-emitting zone during the valid data period.

7. The display equipment of claim 1, wherein after a frame rate of the video stream is switched from a high-frequency mode to a low-frequency mode, the first backlight control circuit and the second backlight control circuit drive the backlight module in the low-frequency mode to provide a normal backlight to the display panel during the valid data period and the blank period.

8. The display equipment of claim 1, wherein a frame rate of the video stream is switched from a low-frequency mode to a transition mode and then to a high-frequency mode, in the low-frequency mode, the first backlight control circuit and the second backlight control circuit drive the backlight module to provide a normal backlight to the display panel during the valid data period and the blank period;

in the transition mode, the first backlight control circuit makes the backlight module not emit a light during a first period of the valid data period, the first backlight control circuit makes the backlight module provide the main backlight to the display panel during a second period of the valid data period, and the second backlight control circuit makes the backlight module provide the compensation backlight to the display panel during the blank period; and in the high-frequency mode, the first backlight control circuit makes the backlight module not emit a light during a third period of the valid data period, the first backlight control circuit makes the backlight module provide the main backlight to the display panel during a fourth period of the valid data period, and the second backlight control circuit makes the backlight module provide the compensation backlight to the display panel during the blank period, wherein a time length of the first period is less than a time length of the third period.

9. An operating method of a display equipment, comprising:

providing a video stream by an image processing circuit of the display equipment, wherein the video stream comprises a variable refresh rate (VRR) video frame;

driving a display panel of the display equipment according to the VRR video frame via a panel control circuit of the display equipment to display an image;

providing a first timing information about a valid data period of the VRR video frame via the image processing circuit;

generating at least one main dimming signal during the valid data period according to the first timing information via a first backlight control circuit of the display equipment to drive a backlight module of the display equipment, so that the backlight module comprising a plurality of light emitting elements provides a main backlight to the display panel during the valid data period;

providing a second timing information about a blank period of the VRR video frame via the image processing circuit; and generating at least one compensation dimming signal via a second backlight control circuit of the display equipment during the blank period according to the second timing information to drive the backlight module, so that the backlight module provides a compensation backlight to the display panel during the blank period;

wherein a peak current value of the at least one compensation dimming signal during the blank period is less than a peak current value of the at least one main dimming signal during the valid data period, wherein a duty ratio of the at least one main dimming signal during the valid data period is less than a duty ratio of the at least one compensation dimming signal during the blank period, so that an average brightness of the compensation backlight during the blank period conforms to an average brightness of the main backlight during the valid data period.

10. The operation method of claim 9, further comprising:

determining a turn-on time of each of a plurality of light-emitting zones of the backlight module according to a response time of the display panel and a writing period of at least one target display area of the display panel; and generating the first timing information according to the turn-on times.

11. The operation method of claim 10, wherein the backlight module is a local dimming backlight module, and the operation method further comprises:

determining, individually, a light-emitting time of a corresponding one in the plurality of light-emitting zones of the backlight module according to the response time of the display panel and a plurality of writing periods of a plurality of target display areas of the display panel.

12. The operation method of claim 9, wherein the backlight module is a local dimming backlight module, the at least one main dimming signal comprises a first zone main signal and a second zone main signal, the first zone main signal is suitable for driving a first light-emitting zone of the backlight module, the second zone main signal is suitable for driving a second light-emitting zone of the backlight module, and a first duty ratio of the first zone main signal during the valid data period is different from a second duty ratio of the second zone main signal during the valid data period.

13. The operation method of claim 12, wherein the at least one compensation dimming signal comprises a first zone compensation signal and a second zone compensation signal, the first zone compensation signal is suitable for driving the first light-emitting zone, the second zone compensation signal is suitable for driving the second light-emitting zone, the first duty ratio is less than a third duty ratio of the first zone compensation signal during the blank period so that an average brightness of the first light-emitting zone during the blank period conforms to an average brightness of the first light-emitting zone during the valid data period, and the second duty ratio is less than a fourth duty ratio of the second zone compensation signal during the blank period so that an average brightness of the second light-emitting zone during the blank period conforms to an average brightness of the second light-emitting zone during the valid data period.

14. The operation method of claim 9, wherein a frame rate of the video stream is switched from a low-frequency mode to a transition mode and then to a high-frequency mode, and the operation method further comprises:

driving, in the low-frequency mode, the backlight module via the first backlight control circuit and the second backlight control circuit to provide a normal backlight to the display panel during the valid data period and the blank period;

making the backlight module not emit a light during a first period of the valid data period via the first backlight control circuit, making the backlight module provide the main backlight to the display panel during a second period of the valid data period via the first backlight control circuit, and making the backlight module provide the compensation backlight to the display panel during the blank period via the second backlight control circuit in the transition mode; and making the backlight module not emit a light during a third period of the valid data period via the first backlight control circuit, making the backlight module provide the main backlight to the display panel during a fourth period of the valid data period via the first backlight control circuit, and making the backlight module provide the compensation backlight to the display panel during the blank period via the second backlight control circuit in the high-frequency mode, wherein a time length of the first period is less than a time length of the third period.

15. A backlight control device, comprising:

an image processing circuit configured to provide a video stream to a panel control circuit, wherein the video stream comprises a variable refresh rate (VRR) video frame, and the panel control circuit drives a display panel to display an image according to the VRR video frame, the image processing circuit further provides a first timing information during a valid data period of the VRR video frame, and the image processing circuit also provides a second timing information about a blank period of the VRR video frame;

a first backlight control circuit coupled to the image processing circuit to receive the first timing information and configured to generate at least one main dimming signal during the valid data period according to the first timing information to drive a backlight module comprising a plurality of light emitting elements, so that the backlight module provides a main backlight to the display panel during the valid data period; and a second backlight control circuit coupled to the image processing circuit to receive the second timing information and configured to generate at least one compensation dimming signal during the blank period according to the second timing information to drive the backlight module, so that the backlight module provides a compensation backlight to the display panel during the blank period, wherein a peak current value of the at least one compensation dimming signal during the blank period is less than a peak current value of the at least one main dimming signal during the valid data period, wherein a duty ratio of the at least one main dimming signal during the valid data period is less than a duty ratio of the at least one compensation dimming signal during the blank period, so that an average brightness of the compensation backlight during the blank period conforms to an average brightness of the main backlight during the valid data period.

16. The backlight control device of claim 15, wherein the image processing circuit comprises:

an interface circuit configured to receive an original VRR stream from a host; and a video scaler coupled to the interface circuit to receive the original VRR stream and configured to adjust a resolution of the original VRR stream to generate the video stream to the panel control circuit.

17. The backlight control device of claim 15, wherein the image processing circuit determines a turn-on time of each of a plurality of light-emitting zones of the backlight module according to a response time of the display panel and a writing period of at least one target display area of the display panel, and generates the first timing information according to the turn-on times.

18. The backlight control device of claim 17, wherein the backlight module is a local dimming backlight module, and the image processing circuit individually determines a light-emitting time of a corresponding one in the plurality of light-emitting zones of the backlight module according to the response time of the display panel and a plurality of writing periods of a plurality of target display areas of the display panel.

19. The backlight control device of claim 15, wherein the backlight module is a local dimming backlight module, the at least one main dimming signal comprises a first zone main signal and a second zone main signal, the first zone main signal is suitable for driving a first light-emitting zone of the backlight module, the second zone main signal is suitable for driving a second light-emitting zone of the backlight module, and a first duty ratio of the first zone main signal during the valid data period is different from a second duty ratio of the second zone main signal during the valid data period.

20. The backlight control device of claim 19, wherein the at least one compensation dimming signal comprises a first zone compensation signal and a second zone compensation signal, the first zone compensation signal is suitable for driving the first light-emitting zone, the second zone compensation signal is suitable for driving the second light-emitting zone, the first duty ratio is less than a third duty ratio of the first zone compensation signal during the blank period so that an average brightness of the first light-emitting zone during the blank period conforms to an average brightness of the first light-emitting zone during the valid data period, and the second duty ratio is less than a fourth duty ratio of the second zone compensation signal during the blank period so that an average brightness of the second light-emitting zone during the blank period conforms to an average brightness of the second light-emitting zone during the valid data period.

21. The backlight control device of claim 15, wherein a frame rate of the video stream is switched from a low-frequency mode to a transition mode and then to a high-frequency mode, in the low-frequency mode, the first backlight control circuit and the second backlight control circuit drive the backlight module to provide a normal backlight to the display panel during the valid data period and the blank period;

in the transition mode, the first backlight control circuit makes the backlight module not emit a light during a first period of the valid data period, the first backlight control circuit makes the backlight module provide the main backlight to the display panel during a second period of the valid data period, and the second backlight control circuit makes the backlight module provide the compensation backlight to the display panel during the blank period; and in the high-frequency mode, the first backlight control circuit makes the backlight module not emit a light during a third period of the valid data period, the first backlight control circuit makes the backlight module provide the main backlight to the display panel during a fourth period of the valid data period, and the second backlight control circuit makes the backlight module provide the compensation backlight to the display panel during the blank period, wherein a time length of the first period is less than a time length of the third period.

* * * * *